US005620247A

United States Patent [19]

Swanson

[11] Patent Number: 5,620,247

[45] Date of Patent: Apr. 15, 1997

[54] TORCHIERE LAMP HAVING SEPARATE TWIN FLEX TASK LIGHT

[75] Inventor: Dennis K. Swanson, Woodland Hills, Calif.

[73] Assignee: Lamps Plus, Inc., Chatsworth, Calif.

[21] Appl. No.: 581,415

[22] Filed: Dec. 29, 1995

[51] Int. Cl.[6] ..... F21S 1/12

[52] U.S. Cl. ..... 362/250; 362/287; 362/413; 362/414; 362/430; 362/431

[58] Field of Search ..... 362/238, 239, 362/250, 410, 413, 275, 414, 430, 285, 287, 418, 419, 427

[56] References Cited

U.S. PATENT DOCUMENTS

| | | | |
|---|---|---|---|
| 1,745,396 | 2/1930 | Adams | 362/413 |
| 1,790,500 | 1/1931 | Fischer | 362/413 |
| 2,041,847 | 5/1936 | Marchand | 362/410 |
| 2,925,489 | 2/1960 | Schwartz | 362/430 |
| 4,232,357 | 11/1980 | Dietz | 362/430 |
| 4,885,667 | 12/1989 | Selden | 362/430 |

*Primary Examiner*—Ira S. Lazarus
*Assistant Examiner*—Thomas M. Sember
*Attorney, Agent, or Firm*—Robbins, Berliner & Carson, LLP

[57] ABSTRACT

A stand-alone electric lamp which includes a base and a general area light source affixed an opposite end of one of a pair of stems to provide general area lighting. Disposed on the stems intermediate the base and the general area light source is a support member in the form of an elongated plate. The other of the stems terminates at the plate. Extending from the plate is an arm which has attached to its end a light source for providing task lighting directable to specific areas. The arm has a pair of flexible sections disposed therein to allow the task light to be adjustable to direct the light therefrom to the desired area.

4 Claims, 2 Drawing Sheets

FIG. 5
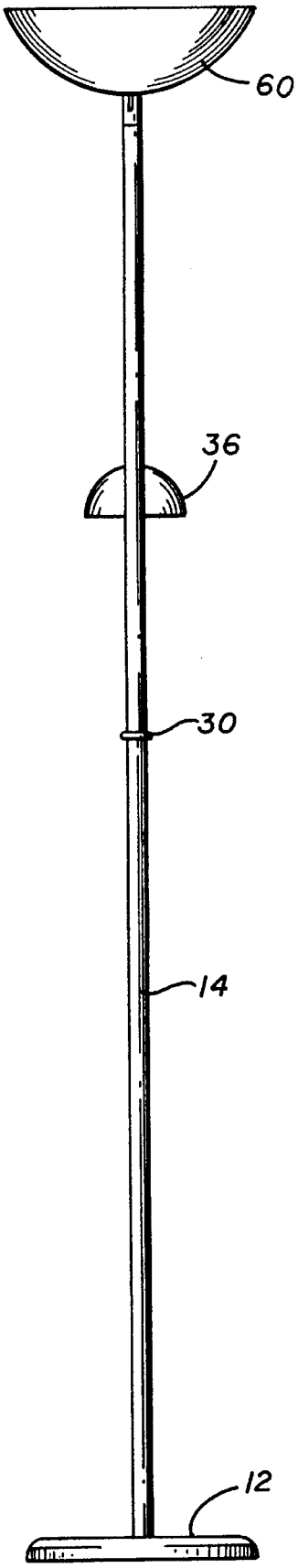
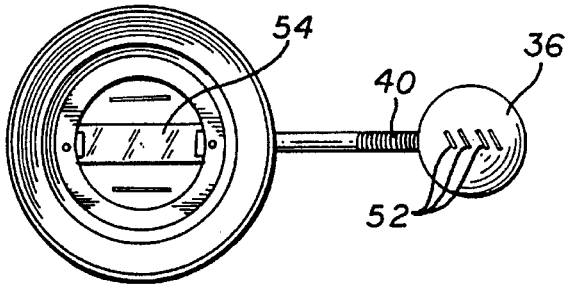
FIG. 6
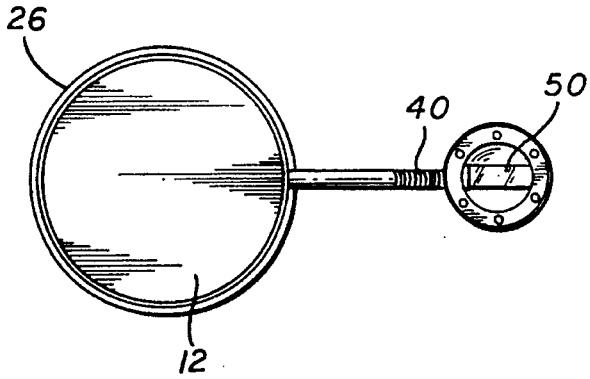
FIG. 7
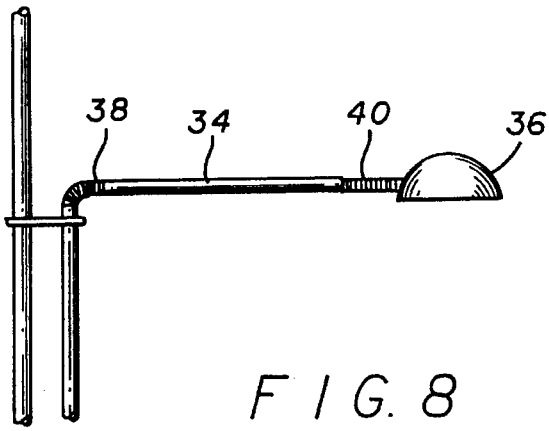
FIG. 8

TORCHIERE LAMP HAVING SEPARATE TWIN FLEX TASK LIGHT

BACKGROUND OF THE INVENTION

1. Field of the Invention

The present invention relates generally to electric lighting apparatus and more particularly to a torchiere lamp which includes the combination of general area lighting and separate task lighting extending from the same base structure.

2. Prior Art

Electric lighting apparatus in the form of floor lamps and table lamps is well known. Such lamps generally take the form of a general area lighting device or alternatively, a task lighting device. A general lighting apparatus is one which provides lighting for a predetermined area without particular concern for directing the light for reading, highlighting specific items such as paintings or the like or otherwise. On the other hand, task lighting focuses the light through the utilization of reflectors for use for a specific purpose such as reading, to highlight a given area, to accent some item such as a sculpture, painting or the like. An example of task lighting structures are the well known pole lamps or track lighting structures.

While the prior art general area lighting devices and task lighting devices have functioned quite well for the specific purposes intended, Applicant is unaware of any prior art which combines both general area lighting and task lighting into a single electric lamp apparatus where the task light is separate from the torchiere but extends from the same base structure.

SUMMARY OF THE INVENTION

An electric lamp which includes a base member for supporting the same, a pair of stems rising from the base member, a general area lighting means carried by the opposite end of one of the pair of stems. A coupling member centrally disposed and affixed to the pair of stems. A separate direct light reflector affixed to the other stem by a flexible arm. Electrical wiring is disposed within each of the stems and is combined with switch means for individually controlling the application of electrical energy to the general area lighting means and the separate task light.

BRIEF DESCRIPTION OF THE DRAWINGS

FIG. 5 is a rear view of the lamp as shown in FIG. 1; and

FIG. 6 is a top view of the lamp as shown in FIG. 1;

FIG. 7 is a bottom view of the lamp as shown in FIG. 1;

FIG. 8 is a fragmentary view further illustrating the flexible adjustment of the task light.

DETAILED DESCRIPTION

Figure 1:
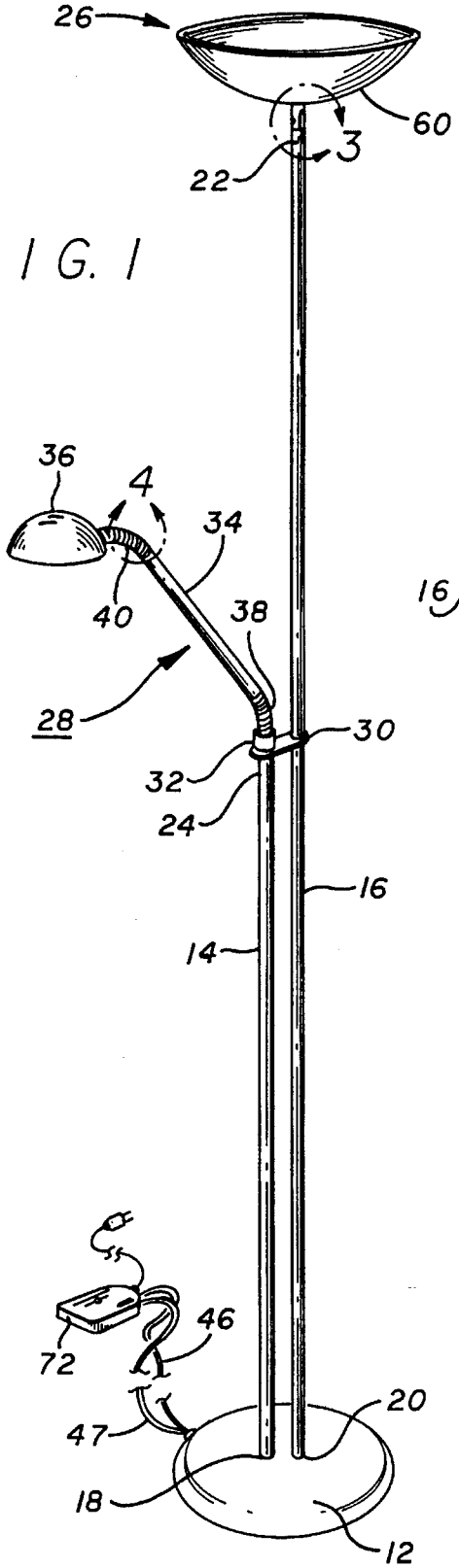
FIG. 1 is a perspective view illustrating an electric lamp constructed in accordance with the principles of the present invention.

As illustrated in the drawings and more particularly in FIG. 1, there is provided a stand-alone lamp 10 having a base 12 from which extends a pair of hollow stems 14 and 16. The stems 14 and 16 have first ends 18 and 20 respectively which are rigidly affixed to the base 12 by appropriate fastening apparatus such as nuts and washers known to those skilled in the art. A second end 22 of the stem 16 is affixed centrally to a general area lighting means 26. The second end 24 of the stem 14 is affixed to a task light 28 connected to the second end 24 of the stem 14 and at approximately the mid-point of stem 16 is a central support member in the form of an elongated flat plate 30.

Figure 3:
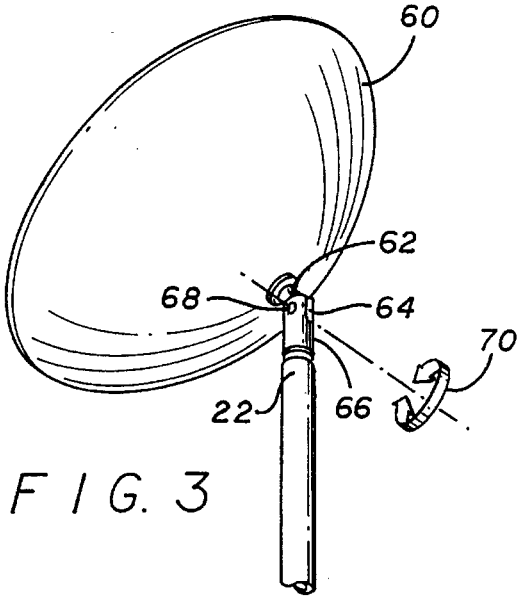
FIG. 3 is a fragmentary, partial, view illustrating the mounting of the general area light.

As is illustrated more specifically in FIGS. 1, 3 and 5 the general purpose lighting means may include an upwardly directed bowl as pan shaped member 60. Extending from the center thereof is an extension member 62 which is received within a slotted recess 64 of a fitting 66. A pin 68 holds the extension member pivotally in place to allow positioning of the pan shaped member 60 by rotation as shown by the arrow 70. Such rotation may be used to direct illumination from the general area lighting means 26 other than upward but also allows positioning thereof for more efficient packaging and transport.

Electrical wiring 46, 47 extends from a switch means 72, through the base 12 and in the hollow interiors of the stems 14 and 16. The switch means 72 may be a foot operated switch which can function as an on-off switch and a dimmer for the lighting means 26, 28.

The task light 28 is affixed to the stem 14 by utilization of an appropriate fitting 32 which is threaded onto the second end 24 of the stem 14. An arm 34 extends from the fitting 32 to the reflector 36 of the task light 28. The arm 34 includes at each end thereof flexible sections 38 and 40 which provide means for easy adjustment of the task light 28 to any position desired. As shown more particularly in FIG. 4, the flexible sections 38 and 40 are constructed from a metallic tubing formed of a spirally wound member having upper and lower offset sections 42 and 44 as shown which allow the sections 38 and 40 to be bent universally in any direction as may be desired to position the reflector 36.

Figure 4:
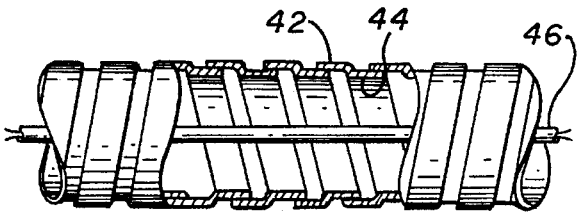
FIG. 4 is a fragmentary, partial cross sectional view illustrating the flexible portions of the task light support arm.

As is also shown in FIG. 4 electrical wiring 46 extends through the hollow interior of the arm 34. The reflector 36 is affixed by way of a fitting 48 to the end of the arm 34 opposite the fitting 32. An appropriate lighting means such as a halogen lamp 50 (FIG. 7) may be received within the reflector 36 to provide the desired illumination to accomplish the desired task of a type above referred to. A plurality of openings 52 are provided in the reflector 36 to permit the escape of heat generated by the halogen lamp 50.

As is shown in FIG. 6 the general area lighting means 26 may also include a halogen lamp 54 for illumination of the general area.

Figure 2:
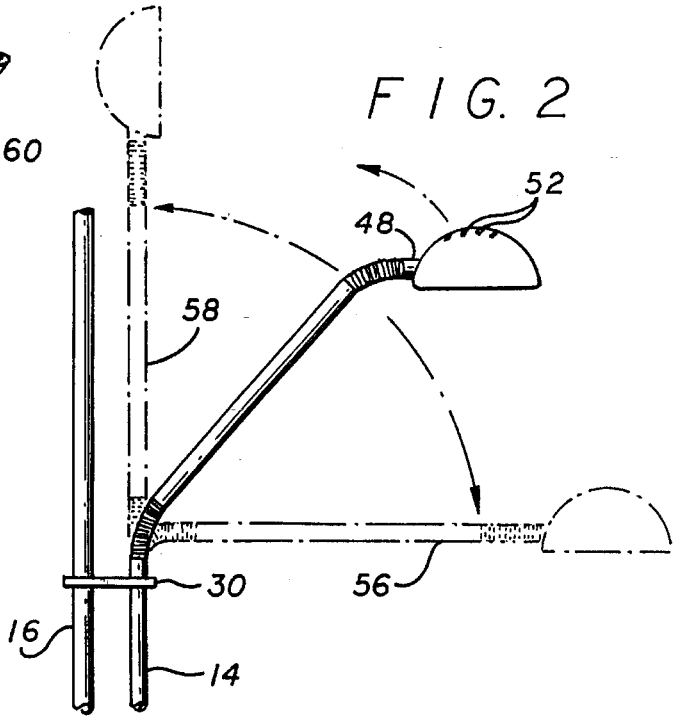
FIG. 2 is a fragmentary perspective view illustrating in more detail the task light forming a part of the lamp and particularly illustrating the flexible adjustment capability of the task light.

As is illustrated more particularly in FIGS. 2 and 8 the arm 34 with the flexible sections 38 and 40 may be manipulated into many different positions, for example those shown by dashed lines 56 and 58, to direct the light from the task light 28 into the desired position to accomplish the desired task.

The present invention has been described in its preferred embodiment as is illustrated in the accompanying drawings. However it should be understood that the invention is not limited by such description and illustration but rather is measured by the scope of the claims appended hereto.

What is claimed is:

1. An electric lamp comprising:

a base member for supporting said lamp;

a general area lighting means in a form of a generally upwardly directed pan shaped reflector having illumination means disposed therein;

a pair of hollow stem members rigidly affixed at one end thereof to said base member;

one of said hollow stem members being affixed at an opposite end thereof to said pan shaped reflector;

a support member disposed between said base member and said pan shaped reflector and affixed to said one of said hollow stem members;

the other of said hollow stem members terminating at and being connected to said support member;

an arm member extending from said support member at the termination said other hollow stem member and terminating in a task light;

said arm member having first and second flexible sections disposed intermediate the ends thereof; and electrical wiring disposed within each of said hollow stem members and said arm member.

2. An electric lamp as defined in claim 1 wherein said flexible sections of said arm member are disposed at opposite ends thereof.

3. An electric lamp as defined in claim 2 wherein said support member is an elongated flat plate permanently affixed to said one of said stem members and defining an opening therethrough within which an end of said other stem member is received.

4. An electric lamp as defined in claim 3 which further includes a fitting affixed to said end of said other stem member and an end of said first flexible section to support said arm member and task light.

* * * * *